US006212692B1

(12) United States Patent
Hu

(10) Patent No.: US 6,212,692 B1
(45) Date of Patent: Apr. 10, 2001

(54) AUTOMATIC QUANTITATIVE REGULATOR FOR DISSOLVENT IN WATER TANK

(76) Inventor: Chao-Yun Hu, 3Fl., No.8, Lane 420, Kuang-Fu S. Rd., Taipei (TW)

( * ) Notice: Subject to any disclaimer, the term of this patent is extended or adjusted under 35 U.S.C. 154(b) by 0 days.

(21) Appl. No.: 09/517,157

(22) Filed: Feb. 29, 2000

(51) Int. Cl.[7] ..... E03D 9/02
(52) U.S. Cl. ..... 4/227.3; 4/227.1
(58) Field of Search ..... 4/227.1, 227.2, 4/227.3, 227.4, 226.1, 222; 222/57, 56, 188, 453

(56) References Cited

U.S. PATENT DOCUMENTS 1,796,086 * 3/1931 Davis ..... 222/322
2,726,406 * 12/1955 Vierra ..... 4/227.3
3,774,808 * 11/1973 La Vange ..... 222/57
4,036,407 * 7/1977 Slone ..... 222/188
4,696,414 * 9/1987 Huat ..... 222/67

* cited by examiner

*Primary Examiner*—Gregory L. Huson
*Assistant Examiner*—Huyen Le
(74) *Attorney, Agent, or Firm*—Rosenberg, Klein & Lee

(57) ABSTRACT

An automatic quantitative regulator for dissolvent in water tank, wherein an inverted jar is clamped on the standing rod in the water tank. An upper float ball is set in the jar mouth shrunk at the bottom, and a bottom float ball is set outside of the jar mouth. Two float balls are joined together by an inner bulgy circle of the fixing coat, and the fixing coat connects with the jar mouth. The two float balls with opposite awl-shape necks are wedged to the aperture formed by inner bulgy circle. The two float balls can be adjusted clearance. When the upper float ball is moved up, the liquid in the jar will flow out gradually. As the upper float ball is moved down, the aperture will be closed. A heavy article is connected with the bottom float ball to accelerate pulling down. Furthermore, a fixed position cup is hooked on the jar, and the bottom of the fixed position cup has a perforated colander.

19 Claims, 10 Drawing Sheets

AUTOMATIC QUANTITATIVE REGULATOR FOR DISSOLVENT IN WATER TANK

BACKGROUND OF THE INVENTION

1. Field of the Invention

The present invention relates to an automatic quantitative regulator for dissolvent in water tank, more particularly to a structure that can make use of the buoyancy and the discharge status of water in the water tank directly to regulate naturally the release of the dissolvent in predetermined quantity.

2. Description of the Prior Art

The toilet dissolvent long time ago is a dissoluble block sunken into the toilet tank and dissolved naturally. But, since the frequency of using the water tank is variable, it will be caused that the concentration maybe too high or too low. Then, the use status is not uniform to be waste or insufficient. Therefore, all kinds of structure are provided to solve the supply problem of the dissolvent. The conventional structure relates that a dissoluble block or a side of the deposited box of dissolvent block is hung on and fixed at the top edge of the water tank wall with a hook. Then, a release pipe is extended below the bottom of the tank, and a spiral rod inserts through the release pipe. The top and bottom ends of the spiral rod have a bolt circle individually. The top end of the spiral rod connects with a sphere and the bottom end of the spiral rod connects with a float ball. Then, the dissolvent will be release when the spiral rod is moved up and down, wherein the spiral rod is of cross-shape. Someone improves the spiral rod to form a bolt, and a spiral coat connects with the release pipe, then, the bolt part is moved in the spiral coat to release the dissolvent. Moreover, someone improves the style of the hook and the form of the deposited box, or improves the bottom end of the bolt to be of awl-shape. Furthermore, someone improves the bolt of the spiral rod to be two layers or have the upper replenishing box. Even though there have been many forms which have the advantages and disadvantages respectively, it is unable to solve all control problem since there is a certain region to supply the dissolvent. This has been the standard structure. As there is some water in the water tank, it will be supplied continuously until the water is full. But the position must be above the water. If the position is in the water, it will be supplied continuously. For obviating the aforementioned problem and conforming to the practical requirements, the invention proceeds to research and develop.

SUMMARY OF THE INVENTION

The primary object of the present invention is to provide an automatic quantitative regulator for dissolvent in water tank, particularly to use a device to accomplish the function for connecting the components in series. The junction of the upper float ball combines with the junction of the bottom float cone, and the two junctions are joined together bulgy threads. The inner side of the fixing coat is also wedged to the mouth of the jar. The wedge motion is accomplished with a form of flat thread. The wedge motion of the two components is rapid and accurate, and the overall composition is simpler. The component number is also decreased. Thus, the release structure is simpler and more convenient than the conventional one.

Another object of the present invention is to provide an automatic quantitative regulator for dissolvent in water tank, particularly to use the jar itself to accomplish the fixing function. As the equipment in the water tank is different, the present invention uses a hook to fix the jar. Then, the present invention can be a sink-water device.

The yet another object of the present invention is to provide an automatic quantitative regulator for dissolvent in water tank, particularly to the part of the jar can be exposed out of the water to provide an outer replenishing bottle. The jars more than one can be replenished to be suitable for the use in the public occasion.

The further object of the present invention is to provide an automatic quantitative regulator for dissolvent in water tank, more particularly, the connection part between the upper and bottom float balls can be adjusted the clearance for conforming to the requirement of various water tank capacities. Thus, the non-section adjustment can be accomplished with using the joint in a form of flat thread or spiral thread.

The structure of the present invention: an inverted jar is clamped on the standing rod in the water tank. An upper float cone is set in the jar mouth shrunk at the bottom, and a bottom float cone is set outside of the jar mouth. Two float cones are joined together by bulgy threads, and the fixing coat connects with the jar mouth. The two float cones with opposite awl-shape necks are wedged to the aperture formed by inner bulgy circle. The two float cones can be adjusted clearance. When the upper float cone is moved up, the liquid in the jar will flow out gradually. As the upper float cone is moved down, the aperture will be closed. A heavy article is connected with the bottom float cone to accelerate pulling down. Furthermore, a fixed position cup is hooked on the jar, and the bottom of the fixed position cup has a perforated colander.

In order that the present invention may be understood more readily, the following description is given, merely be the way of example, reference being made to the accompanying drawings, wherein:

DETAILED DESCRIPTION OF THE PREFERRED EMBODIMENT

Figure 1:
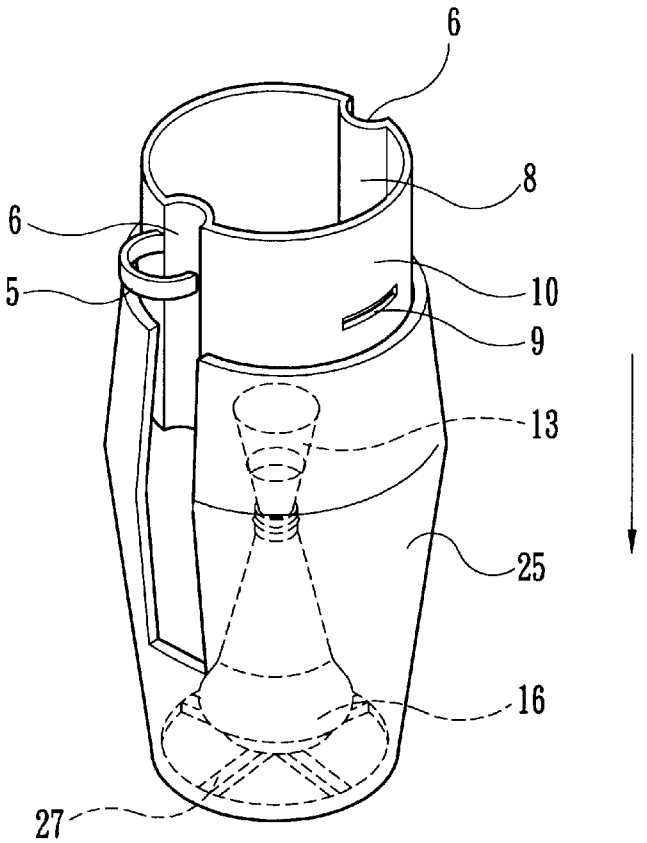
FIG. 1 is the perspective drawing of the present invention.
Figure 2:
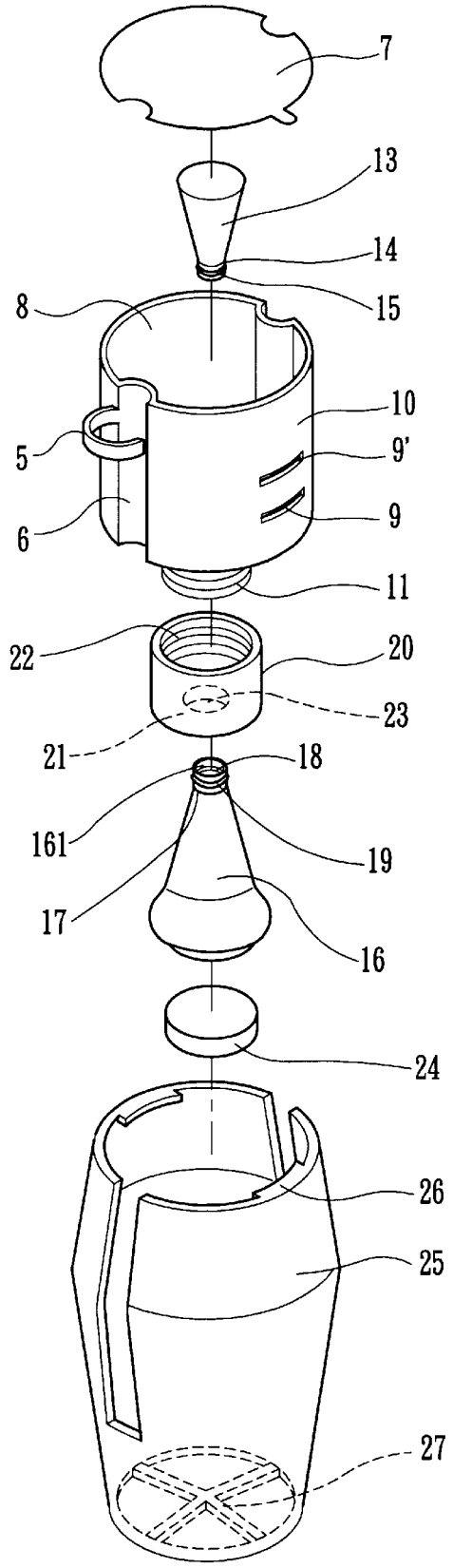
FIG. 2 is the exploded perspective drawing of the present invention.
Figure 3:
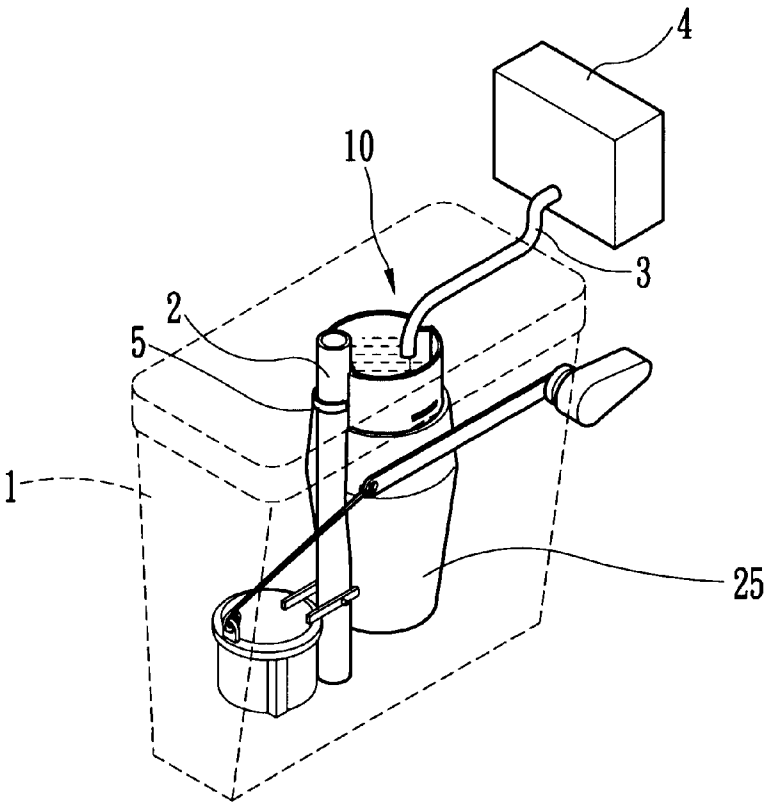
FIG. 3 is the perspective drawing of the preferred embodiment according to the present invention.
Figure 4:
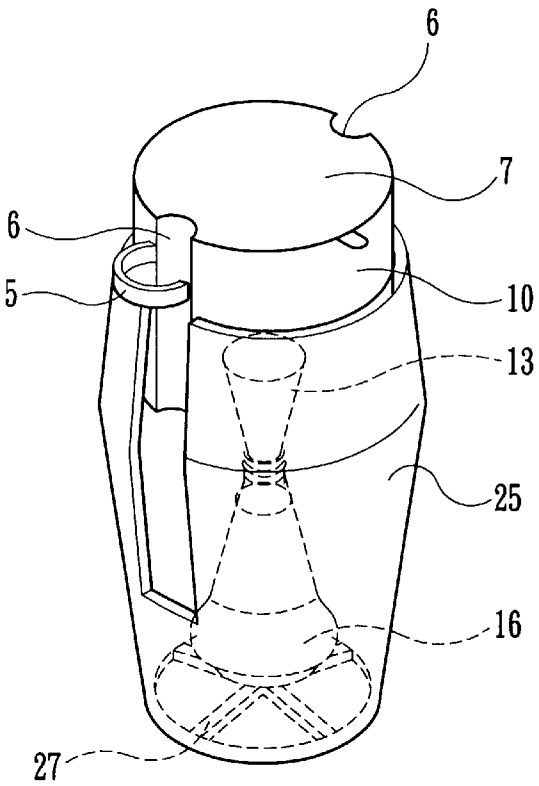
FIG. 4 is the cross-sectional view of the present invention unopened.
Figure 5:
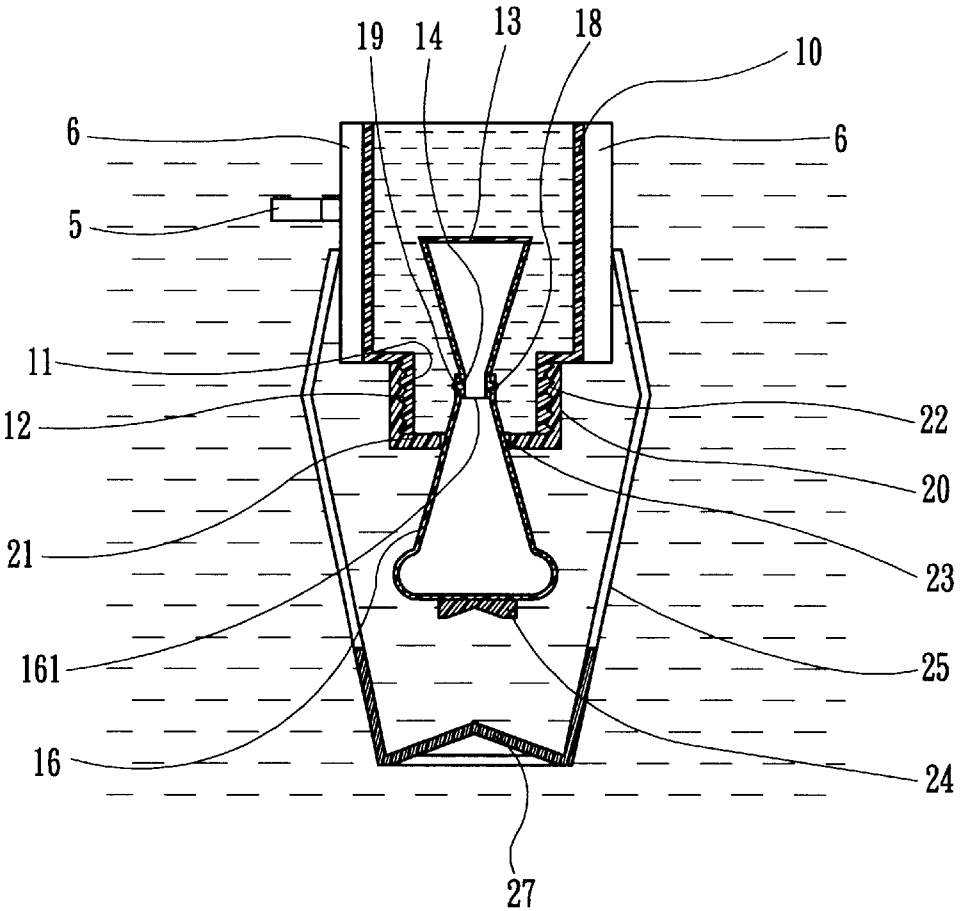
FIG. 5 is the cross-sectional view of the present invention while full of water and not supplying the dissolvent.
Figure 6:
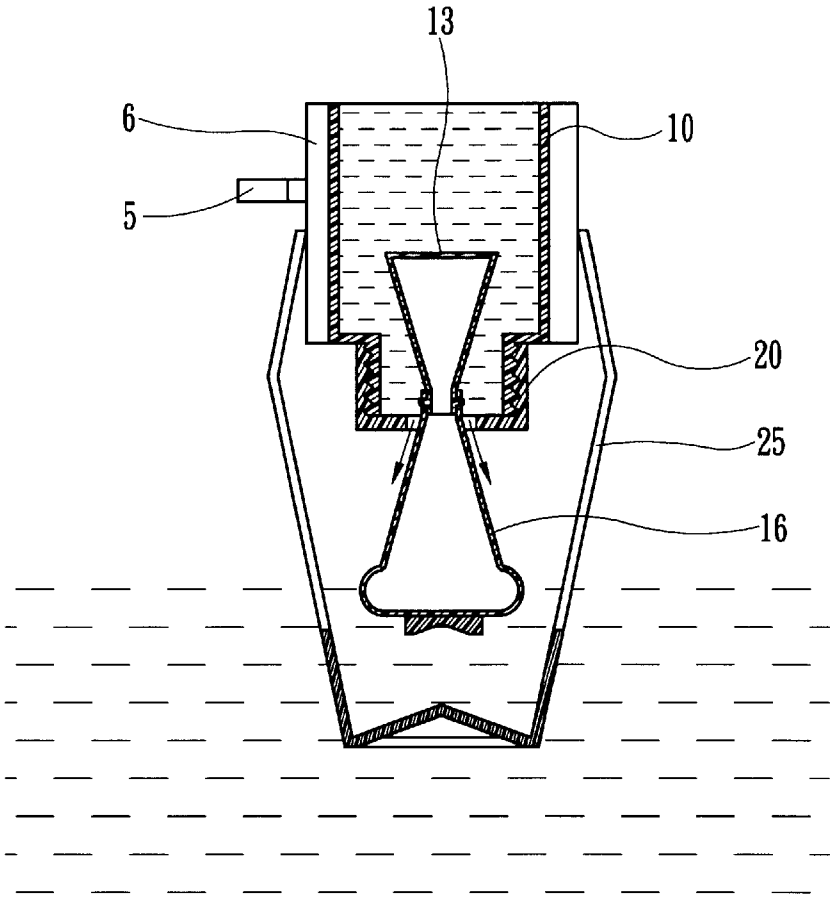
FIG. 6 is the cross-sectional view of the present invention while supplying the dissolvent.
Figure 7:
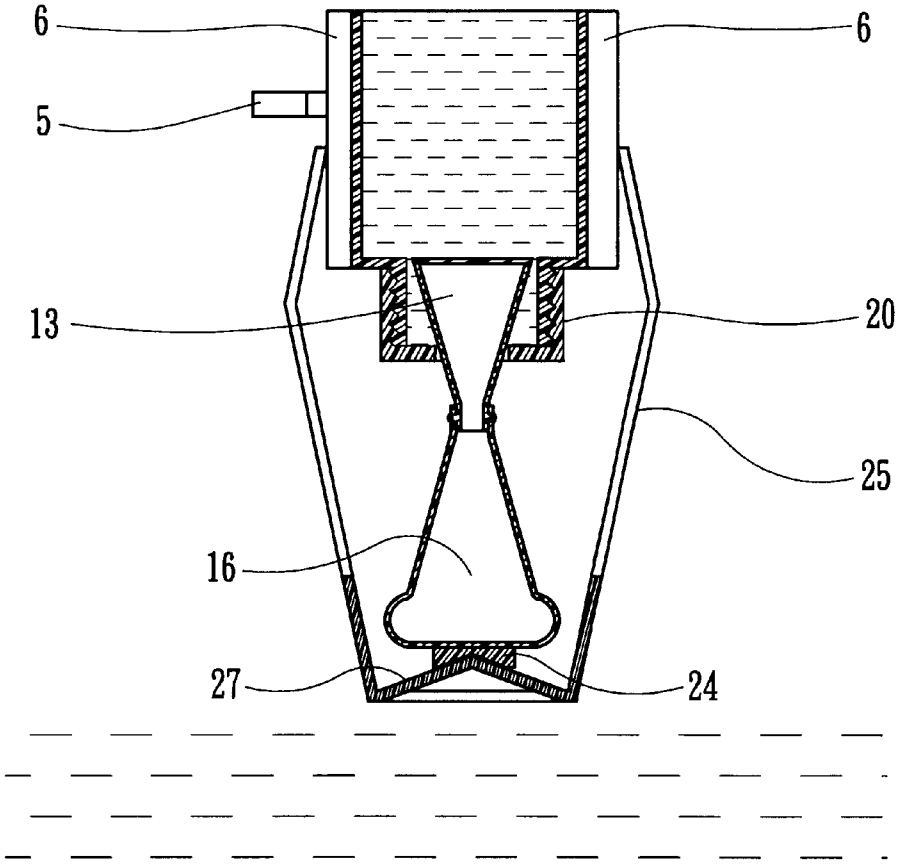
FIG. 7 is the cross-sectional view of the present invention while without water and not supplying the dissolvent.

FIG. 1 to FIG. 10 show the first preferred embodiment of the present invention. The regulator mainly comprises an inverted jar 10 clamped on a standing rod 2 of the water tank 1 and having a jar mouth 11 at bottom. An upper float cone 13 is set in the jar mouth 11 having a diameter smaller relative to at the bottom and a bottom float cone 16 is set outside of the jar mouth 11. Two float cones are joined together by bulgy threads. The neck 14 of the upper float cone 13 has at least one turn of male screw (flat thread) 15 to hook at least one turn of female screw (flat thread) 18, which is at the opposite position of the concave 161 of the bottom float cone 16. The neck 17 of the bottom float cone 16 has an outer bulgy circle 19 at least to connect with the upper float cone 13. Furthermore, the flat thread 22 is wedged to the bulgy flat thread 12 outside the jar mouth 11. The two float cones 13, 16 with opposite awl-shape necks 14, 17 are wedged to the aperture 23 formed by inner bulgy circle. When the upper float cone 13 is moved up, the liquid 3 in the jar 10 will flow out from the aperture 23 gradually. The upper float cone 13 is moved down, the aperture 23 will be closed. A heavy article 24 is connected below the bottom float cone 16 to accelerate pulling down. Furthermore, the connecting part 26 at the top of a fixed position cup 25 hooks a plurality of equal-space bulgy scales 9, 9' on the side of the jar 10. The bottom of the fixed cup 25 has a perforated colander 27 to limit the moving space and swaying range of the bottom float cone 16. Each side of the fixed cup 25 has an aperture individually to arrange in pairs with the ditch 6 of the jar 10. Then, the standing rod 2 passes through the ditch 6 to fix it. The bottom part of the fixed cup is of awl-shape and shrink. Therefore, it is not need to have a breaking ditch. Then, the perforated colander 27 of the fixed cup 25 can be a cross-shape of upward bulgy form or flat form, and the former is better.

The top of the jar 10 forms a replenishing aperture 8. The replenishing aperture 8 is sealed with the cover 7. The appearance of the jar 10 has a vertical ditch 6 at least, and the ditch 6 of the jar 10 joins up the standing rod 2 of the water tank 1. Or the ditches 6 on the sides of the jar join up a pair of standing rods 2 of the water tank 1. If there is only a standing rod 2 in the water tank 1, the jar 10 is fixed by a two-end hook 5 at least. An end of the hook 5 joins up the standing rod of the water tank, and the other end joins up the opposite ditch 6 of the jar 10. Then, there is a replenishing box 4 outside the water tank to replenish the dissolvent into the jar 10 by a supply pipe 3. Even, more than one of the jars 10 can be replenished in the water tank at the same time. Most of families need only use a can form, and replace a new one when run out of it. In the public occasion, the replenishing form is suitable.

In the structure of the aforementioned first embodiment, the present invention uses very simple component structures to be composed, more particularly, the connection between the upper and bottom float cones forms a style like a valve. The flow of the dissolvent liquid is under control of the water in the water tank completely. When the water is discharged completely, the pair formed by the bottom float cone and the upper float cone move down rapidly because of the heavy article and the suction of discharging water. Then, the upper float cone closes the aperture, the dissolvent is not released. When the water comes in gradually, the pair of float cone will be pushed up and the aperture appears. Then, the little dissolvent will be released. As the water is full, the float cone pair will be pushed up completely and the bottom float cone closes the aperture. When the jar of the present invention is composed, a fixed position cup is set to prevent the fault operation. The fixed position cup is on the upper scale 9 to press and then close the aperture completely. For installing and using, the fixed position cup is removed to the bottom scale 9'. The upward bulgy part at the bottom of the fixed position cup can prevent the shifting of the float ball pair too large, and then form a cover structure for closing the aperture of the unused jar. It is different from the conventional closed type cover. Furthermore, the present invention can be a closed type to set in water or an opened type to set above water. The connection form using import-pipe or export-pipe, the joint by the jar of self, and the aiding hook are all new designs which are different from the prior art. It is provided to better utility value, and the present invention is a different structure from the prior art.

Figure 8:
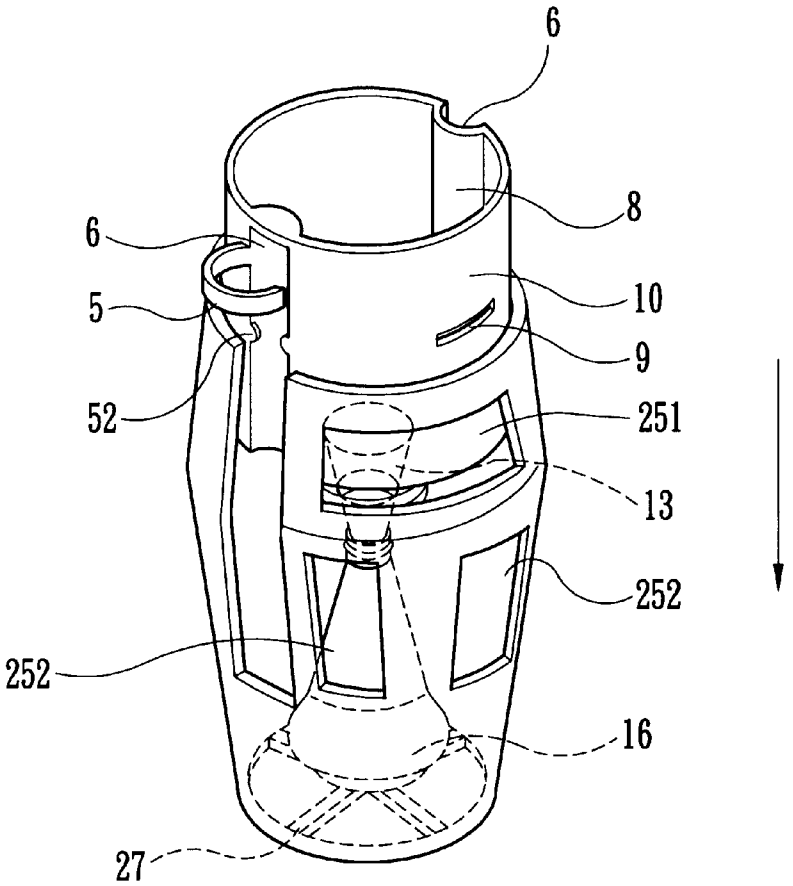
FIG. 8 is the perspective drawing of another preferred embodiment according to the present invention.
Figure 9:
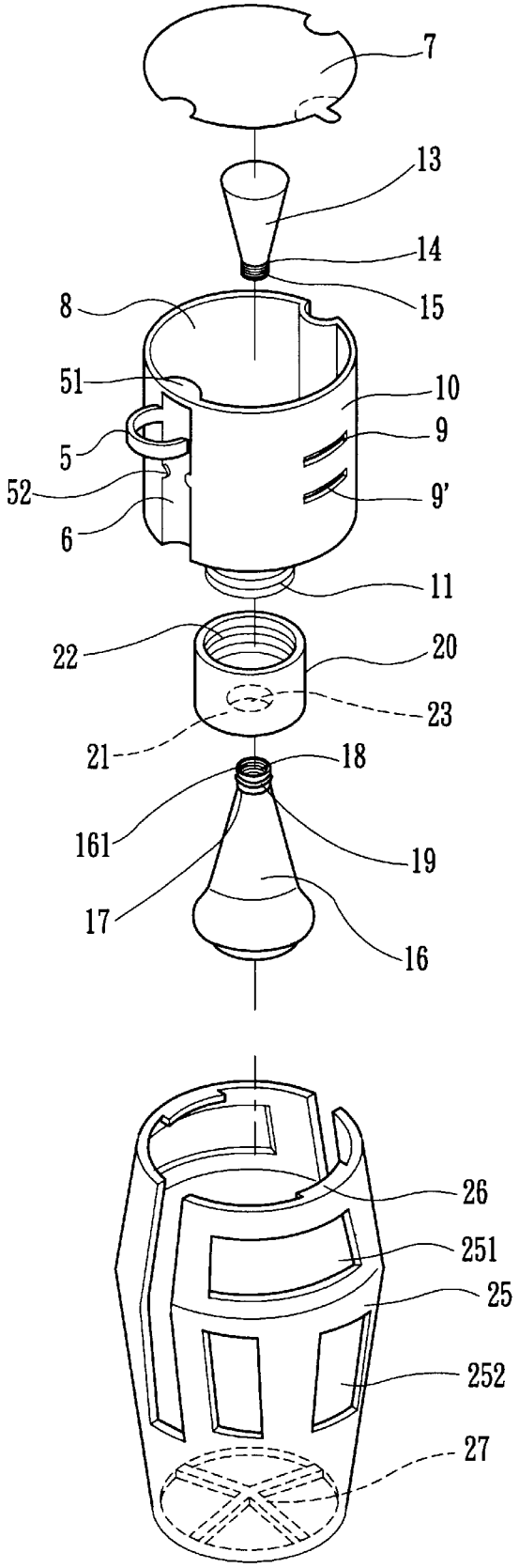
FIG. 9 is the exploded perspective drawing of another preferred embodiment according to the present invention.
Figure 10:
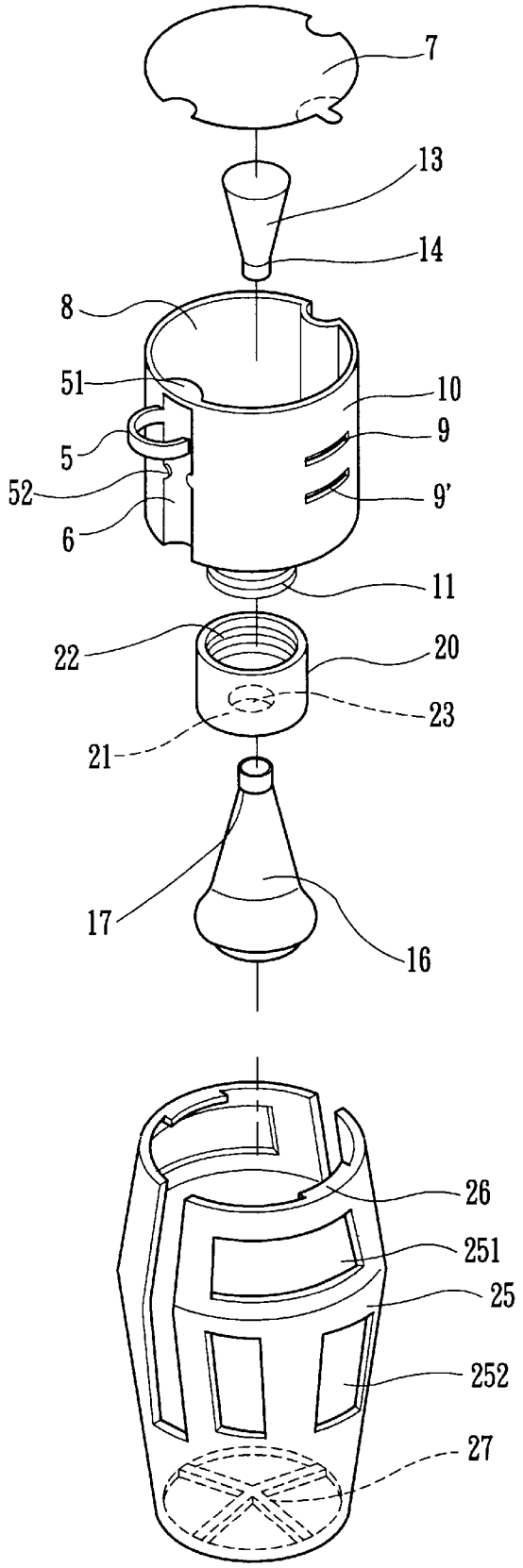
FIG. 10 is the perspective drawing of further preferred embodiment according to the present invention.

Furthermore, referring the another embodiment shown as FIG. 8 and FIG. 9 relates to the second embodiment according to the present invention. There are some differences from the first embodiment. On the top end of the ditch 6 beside the hook 5 on the top of the jar 10, there is a small lid 51 to hook the top end of the standing rod 2. A bulgy point 52 is used to fix on the standing rod 2. The connection part between the upper and bottom float cones 13,16 can be adjusted the clearance for conforming to the requirement of various water tank capacities. Thus, some opposite flat threads or spiral threads will be provided to accomplish the adjustment function. Then, the big windows 251 and the small windows 252 on the fixed position cup 25 can accomplish the function releasing the dissolvent rapidly. It does not need to arrange in pair with the heavy article 24. Only the material and the shape of the bottom float cone 16 itself can replace the heavy article with iron slice. Referring to FIG. 10, there are not any lines between the upper and bottom float cones, and only the closed connection at the plane of the neck to accomplish the non-sectional adjustment function.

Although the present invention has been described with reference to the preferred embodiments thereof, it will be understood that the invention is not limited to the details thereof Various substitutions and modifications have suggested in the foregoing description, and other will occur to those of ordinary skill in the art. Therefore, all such substitutions and modifications intend to be embraced within the scope of the invention as defined in the appended claims.

What is claimed is:

1. An automatic quantitative regulator for dissolvent in water tank, wherein:

an inverted jar adapted to be clamped on a standing rod arranged within said water tank, an upper float ball arranged in a jar mouth which has a diameter smaller relative to the bottom of said jar and a bottom float cone set outside of said jar mouth, said float cones joined together by bulgy threads and a fixing coat having an inner bulgy circle, said fixing coat connected connects with said jar mouth, said two float cones with opposite awl-shape necks are wedged to an aperture formed within inner bulgy circle, when said upper float cone is moved up, the liquid in the jar will flow out gradually, as said upper float cone is moved down, said aperture will be closed.

2. The automatic quantitative regulator for dissolvent in water tank as claimed 1, wherein a fixed position cup is hooked on the jar and the bottom of said fixed position cup has a perforated colander.

3. The automatic quantitative regulator for dissolvent in water tank as claimed 2, wherein the connecting part at the top of said fixed position cup hooks a plurality of equal-space bulgy scales on the jar.

4. The automatic quantitative regulator for dissolvent in water tank as claimed 2, wherein the perforated colander of said fixed position cup can be of upward bulgy cross-shape.

5. The automatic quantitative regulator for dissolvent in water tank as claimed 2, wherein there are many windows on said fixed position cup to accelerate the release of the liquid in the jar.

6. The automatic quantitative regulator for dissolvent in water tank as claimed 1, wherein a heavy article is connected with said bottom float cone to accelerate pulling down.

7. The automatic quantitative regulator for dissolvent in water tank as claimed 1, wherein the neck of said upper float cone has a bulgy circle at least to hook an inner bulgy circle, which is at the opposite position of the concave of said bottom float cone.

8. The automatic quantitative regulator for dissolvent in water tank as claimed 7, wherein the neck of said bottom float cone has an outer bulgy circle at least to connect with said upper float cone.

9. The automatic quantitative regulator for dissolvent in water tank as claimed 7, wherein the bulgy threads of said upper float cone and said bottom float cone are flat threads.

10. The automatic quantitative regulator for dissolvent in water tank as claimed 7, wherein the bulgy threads of said upper float cone and said bottom float cone can be spiral threads to adjust the clearance up and down.

11. The automatic quantitative regulator for dissolvent in water tank as claimed 1, wherein a non-section adjustment can be accomplished since there are opposite necks to connect closely between said upper float cone and said bottom float cone.

12. The automatic quantitative regulator for dissolvent in water tank as claimed 1, wherein the top of the jar forms a replenishing aperture.

13. The automatic quantitative regulator for dissolvent in water tank as claimed 12, wherein said replenishing aperture is sealed by a cover.

14. The automatic quantitative regulator for dissolvent in water tank as claimed 1, wherein the appearance of the jar has a vertical ditch at least.

15. The automatic quantitative regulator for dissolvent in water tank as claimed 14, wherein said ditch of the jar joins up the standing rod of the water tank.

16. The automatic quantitative regulator for dissolvent in water tank as claimed 14, wherein the ditches at the sides of the jar are adapted to join up a pair of standing rods in the water tank.

17. The automatic quantitative regulator for dissolvent in water tank as claimed 14, wherein a hook is adapted to be used to fix the jar on the standing rod at least.

18. The automatic quantitative regulator for dissolvent in water tank as claimed 14, wherein there is a bulgy point outside the ditch of the jar.

19. The automatic quantitative regulator for dissolvent in water tank as claimed 14, wherein there is a small lid to hook the top end of the standing rod.

* * * * *